US007520500B2

(12) United States Patent
Park

(10) Patent No.: US 7,520,500 B2
(45) Date of Patent: Apr. 21, 2009

(54) MEDIA SEPARATING APPARATUS AND METHOD FOR AUTOMATIC MEDIA DISPENSER

(75) Inventor: Eung Min Park, Seoul (KR)

(73) Assignee: LG N-SYS Inc., Seoul (KR)

( * ) Notice: Subject to any disclaimer, the term of this patent is extended or adjusted under 35 U.S.C. 154(b) by 330 days.

(21) Appl. No.: 11/293,274

(22) Filed: Dec. 5, 2005

(65) Prior Publication Data

US 2006/0145410 A1 Jul. 6, 2006

(30) Foreign Application Priority Data

Dec. 9, 2004 (KR) ..... 10-2004-0103751

(51) Int. Cl.
*B65H 3/06* (2006.01)

(52) U.S. Cl. ..... 271/10.13; 271/10.11; 271/116

(58) Field of Classification Search ..... 271/10.04, 271/10.11, 10.13, 110, 114, 116, 111, 259
See application file for complete search history.

(56) References Cited

U.S. PATENT DOCUMENTS 2,592,822 A * 4/1952 Rapp et al. ..... 271/10.13
2,592,922 A * 4/1952 Lucier ..... 24/6
4,813,658 A * 3/1989 Hosking et al. ..... 271/10.04
5,476,254 A * 12/1995 Golicz ..... 271/10.05
5,664,771 A * 9/1997 Nagatani et al. ..... 271/10.03
6,439,564 B2 * 8/2002 Andersson et al. ..... 271/10.03
6,773,009 B2 * 8/2004 So ..... 271/259
6,962,332 B2 * 11/2005 Su ..... 271/4.01
7,136,202 B2 * 11/2006 Jang et al. ..... 358/474

* cited by examiner

*Primary Examiner*—Kaitlin S Joerger
(74) *Attorney, Agent, or Firm*—Birch, Stewart, Kolasch & Birch, LLP

(57) ABSTRACT

The present invention relates to a media separating apparatus and method for an automatic media dispenser. The media separating apparatus of the present invention comprises a pickup roller 24 which is installed on a pickup roller shaft 28 driven by a first driving source 26 to pick up and convey media m stored in a media box 20, a plurality of first feed rollers 42*a* which is installed on a feed roller shaft 46 driven by the first driving source 26 and brought into close contact with one surface of the medium m to convey the medium m using a friction force generated between the medium and the first feed rollers, a second feed roller 42*b* which is installed on the feed roller shaft 46 via a bearing and rotated by a second driving source 44 driven separately from the first driving source 26 to convey the medium m, and a plurality of separating rollers 56 which are installed to correspond to outer circumference surfaces of the first and second feed rollers 42*a* and 42*b* and to separate out the media m one by one in cooperation with the first and second feed rollers 42*a* and 42*b*. According to the present invention so configured, if the picked up medium m is sensed by a media conveyance sensor 34, the operation of the first driving source 26 is stopped such that the pickup roller 24 and the first feed roller 42*a* do not pick up the next medium m. Therefore, there are advantages in that the media m cannot be conveyed in a state where they are overlapped with one another and that reliability in the media separation can also be enhanced.

19 Claims, 5 Drawing Sheets

MEDIA SEPARATING APPARATUS AND METHOD FOR AUTOMATIC MEDIA DISPENSER

BACKGROUND OF THE INVENTION

1. Field of the Invention

The present invention relates to a media dispenser, and more particularly, to an apparatus and method for separating out media one by one from a media box in which the media are stored.

2. Description of the Prior Art

A term of "media" used herein refers to sheets, for example, bills, checks, tickets, certificates and the like which have a thickness remarkably smaller than a width or length.

FIG. 1 shows the configuration of a media separating apparatus for separating out media one by one from a media box in a related art media dispenser. Referring to this figure, the media box 1 is installed within the automatic media dispenser. The media box 1 may be integrally formed or detachably installed in the automatic media dispenser.

Media m are orderly arranged and received in the media box 1. In the media box 1, the media m are brought into close contact with one another in one direction by means of a push plate 3. To this end, the push plate 3 is supported by a spring (not shown). The media m are pushed by a pickup roller 5 in the media box 1 such that the media can be brought into close contact with one another.

The pickup roller 5, which is positioned at one end of the media box brings the media m stored in the media box 1 into close contact with one another and conveys the medium m to the outside of the media box 1. This pickup roller 5 is mounted to a pickup roller shaft 6 driven by a driving source and forwards the medium m, which are brought into contact with an outer circumferential surface of the pickup roller, between a feed roller 7 and a separating roller 9 which will be described below.

Furthermore, the feed roller 7 and the separating roller 9 are provided in pair at a position adjacent to the pickup roller 5 such that the media m are separated out and conveyed one by one by the pickup roller 5 as described above. At this time, the feed roller 7 is rotated in a direction in which the media m are conveyed, while the separating roller 9 is in a stationary state or rotated in a direction opposite to the direction in which the media m are conveyed. Therefore, a difference in conveying force needed to convey the media m is generated between the feed roller 7 and the separating roller 9, and thus, the media m are conveyed one by one.

Idle rollers 11 for guiding the media m, which have passed through the feed roller 7 and the separating roller 9, are provided at one side of an outer circumference of the feed roller 7. The idle rollers 11 are brought into close contact with the outer circumferential surface of the feed roller 7 by springs 11*a*, respectively. These idle rollers 11 serve to guide the medium m, which have been separated out from the feed rolled 7 and the separating roller 9 toward the other module such as a media discharging module and the like.

However, the related art apparatus has the following problems.

In other words, since the pickup roller 5 is rotated until the medium m which has been picked up by and conveyed to the pickup roller has completely passed through the feed roller 7, the pickup roller 5 applies the force for introducing the next medium m between the feed roller 7 and the separating roller 9. Therefore, there is a problem in that the media m are overlapped with one another and then conveyed by the rotation of the pickup roller 5 or the media m are separated out at smaller intervals.

Further, the feed roller 7 always applies a constant conveying force to the medium m. However, the conveying forces needed to convey the medium m are different from each other before and after the medium is introduced between the feed roller 7 and the separating roller 9. That is, the conveying force needed before the medium is introduced between the feed roller and the separating roller is larger than the conveying force needed after the medium has been introduced between the feed roller and the separating roller. Thus, since the feed roller 7 is designed to exhibit the conveying force enough to introduce the medium m between the feed roller 7 and the separating roller 9, the feed roller 7 applies an unnecessarily large conveying force to the medium m even at a region where a small conveying force is required. Consequently, there is a problem in that a surface of the medium m is damaged.

SUMMARY OF THE INVENTION

The present invention is conceived to solve the aforementioned problems in the prior art. Accordingly, an object of the present invention is to provide a media separating apparatus and method for use in an automatic media dispenser capable of preventing the media from being overlapped with each other and then conveyed to the outside.

Another object of the present invention is to provide a media separating apparatus and method for use in an automatic media dispenser capable of varying the conveying force required to convey the media.

According to an aspect of the present invention for achieving the objects, there is provided a media separating apparatus for an automatic media dispenser, comprising; a pickup roller for picking up and conveying media stored in a media box, said pickup roller being installed on a pickup roller shaft; and a plurality of feed rollers for conveying the media with a friction force, said feed rollers being installed on feed roller shafts and being selectively driven.

Preferably, further comprising a plurality of separating rollers installed to correspond to outer circumference surfaces of the feed rollers, said separating rollers cooperating with the feed rollers to separate out the media one by one.

More preferably, the separating rollers are in a stationary state or rotated in a direction opposite to a direction in which the media are conveyed.

More preferably, some of the feed rollers are mounted to the feed roller shaft via a one-way bearing such that some of the feed rollers are rotated integrally with the feed roller shaft when the feed roller shaft is rotated and are in an idle state when the feed roller shaft is in a stationary state.

More preferably, the plurality of feed rollers are installed and independently driven on separate feed roller shafts.

More preferably, further comprising at least two driving sources for driving the plurality of feed rollers.

More preferably, one of the driving sources is a driving source for driving the pickup roller.

More preferably, further comprising a pickup sensor installed at a position adjacent to the pickup roller for sensing whether the medium is ready to be conveyed, wherein the pickup roller is rotated to convey the medium to the feed roller when it is sensed in the pickup sensor that the medium is ready to be conveyed.

More preferably, further comprising a media conveyance sensor for sensing whether the media have been conveyed, wherein the media conveyance sensor is installed on a conveying path past the feed roller in a direction in which the media are conveyed, and the pickup roller is stopped to prevent additional media from being picked up when it is sensed in the media conveyance sensor that the media have been conveyed.

According to other aspect of the present invention for achieving the objects, there is provided a method for separating out media in an automatic media dispenser, comprising the steps of: (a) picking up the media stored in a media box using a pickup roller; (b) conveying the medium picked up by the pickup roller using a plurality of selectively driven feed rollers; and (c) stopping some of the feed rollers when it is sensed that a leading end of the medium has passed through the feed rollers.

Preferably, further comprising the step of, prior to step (a), sensing whether the medium is ready to be conveyed, using a pickup sensor installed at a position adjacent to the pickup roller, and selectively operating the plurality of feed rollers in response to the sensing result.

More preferably, further comprising the step of sensing whether the medium has been conveyed, using a media conveyance sensor provided on a media conveying path, and stopping an operation of the pickup roller in response to the sensing result.

According to another aspect of the present invention for achieving the objects, there is provided a media separating apparatus for an automatic media dispenser, comprising: a pickup roller for picking up and conveying media stored in a media box, said pickup roller being installed on a pickup roller shaft driven by a first driving source; a plurality of first feed rollers installed on a feed roller shaft driven by the first driving source and brought into close contact with one surface of the medium to convey the medium using a friction force generated between the medium and the first feed rollers; a second feed roller installed on the feed roller shaft via a bearing and rotated by a second driving source driven separately from the first driving source to convey the medium; and a plurality of separating rollers installed to correspond to outer circumference surfaces of the first and second feed rollers and to separate out the media one by one in cooperation with the first and second feed rollers.

Preferably, the first feed rollers are mounted to the feed roller shaft via a one-way bearing such that some of the feed rollers are rotated integrally with the feed roller shaft when the feed roller shaft is rotated and are in an idle state when the feed roller shaft is in a stationary state.

More preferably, further comprising a pickup sensor installed at a position adjacent to the pickup roller for sensing whether the medium is brought into contact with the pickup roller and ready to be conveyed, wherein when it is sensed in the pickup sensor that the medium is ready to be conveyed, electric power is supplied to the first driving source such that the pickup roller is rotated to convey the medium between the first and second feed rollers and the separating rollers.

More preferably, further comprising a media conveyance sensor for sensing whether the media have been conveyed, wherein the media conveyance sensor is installed on a conveying path past the first and second feed rollers in a direction in which the media are conveyed, and the electric power supplied to the first driving source is switched off such that the pickup roller is stopped to prevent additional media from being picked up, when it is sensed in the media conveyance sensor that the media have been conveyed.

More preferably, the separating rollers are in a stationary state or rotated in a direction opposite to a direction in which the media are conveyed.

According to another aspect of the present invention for achieving the objects, there is provided a method for separating out media in an automatic media dispenser, comprising the steps of: (a) picking up the media stored in a media box using a pickup roller driven by a first driving source; (b) separating out the media one by one and conveying the separated medium using a first feed roller driven by the first driving source, a second feed roller driven by a separate second driving source and separating rollers corresponding to the first and second feed rollers; and (c) when it is sensed that a leading end of the medium has passed through the first and second feed rollers, stopping an operation of the first driving source and then conveying the medium using only a driving force from the second driving source.

Preferably, further comprising the step of, prior to step (a), sensing whether the medium is brought into contact with the pickup roller and ready to be conveyed, using a pickup sensor installed at a position adjacent to the pickup roller, and selectively applying electric power to the first driving source in response to the sensing result.

More preferably, further comprising the step of, prior to step (c), sensing whether the medium has been conveyed, using a media conveyance sensor provided on a media conveying path past the first and second feed rollers, and selectively switching off the electric power supplied to the first driving source.

According to the present invention so configured, if the picked-up medium is sensed by a sensor for sensing the conveyance of media, the pickup roller and the first feed roller are stopped so as not to pick up the next medium. Thus, the media can be neither overlapped with each other nor conveyed, and can be correctly separated out. Further, since a conveying force needed to convey the media between the feed roller and the separating roller can be properly adjusted according to the position of the medium, the media can be prevented from being damaged.

BRIEF DESCRIPTION OF THE DRAWINGS

The above and other objects, features and advantages of the present invention will become apparent from the following descriptions of preferred embodiments given in conjunction with the accompanying drawings, in which.

DESCRIPTION OF THE PREFERRED EMBODIMENTS

Hereinafter, a preferred embodiment of the media separating apparatus for an automatic media dispenser according to the present invention will be described in detail with reference to the accompanying drawings.

Figure 1:
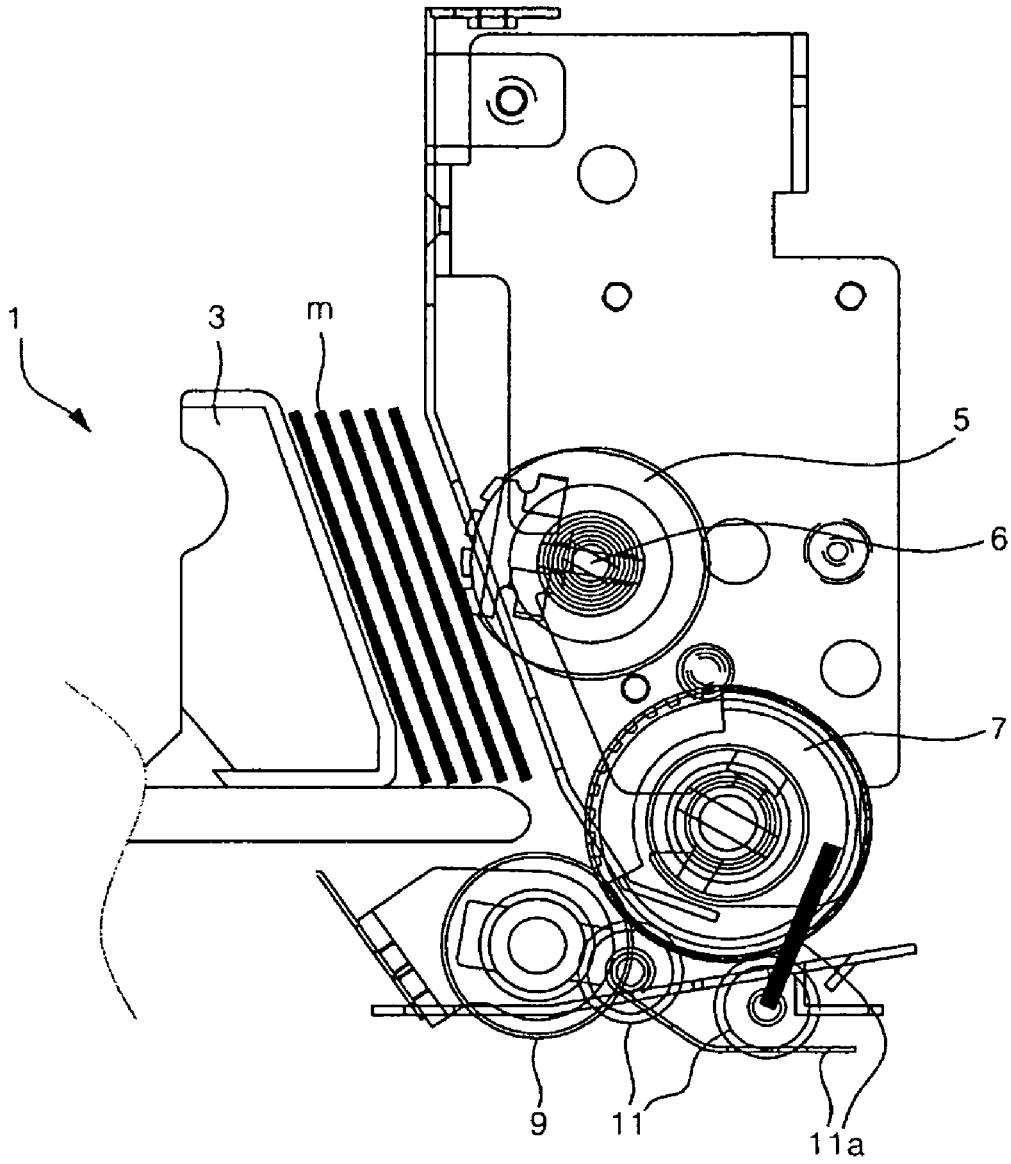
Fig. 1 Related Art
FIG. 1 is a view showing the configuration of a media separating apparatus in a media dispenser according to the prior art.
Figure 2:
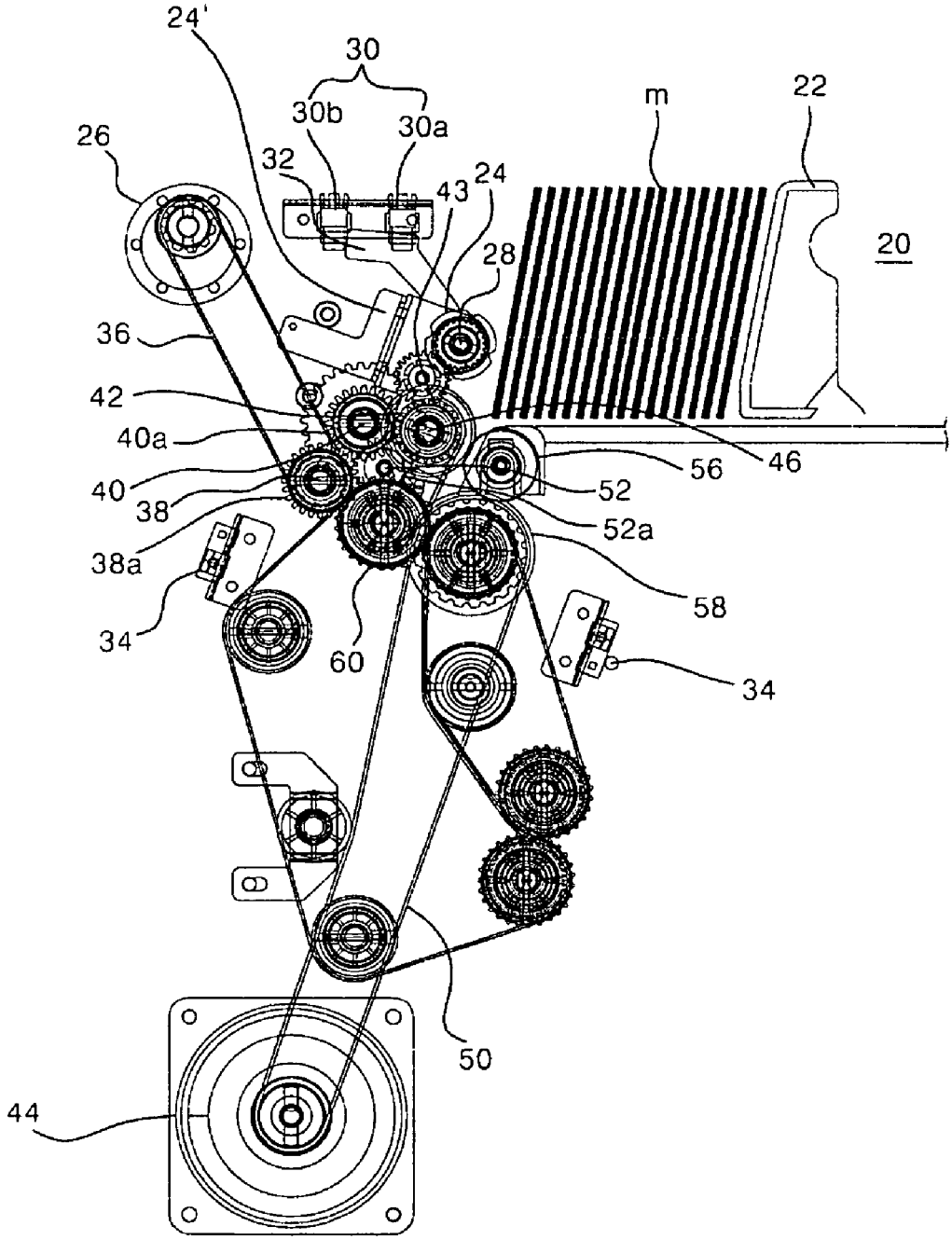
FIG. 2 is a side view showing the configuration of a preferred embodiment of the media separating apparatus in an automatic media dispenser according to the present invention.
Figure 3:
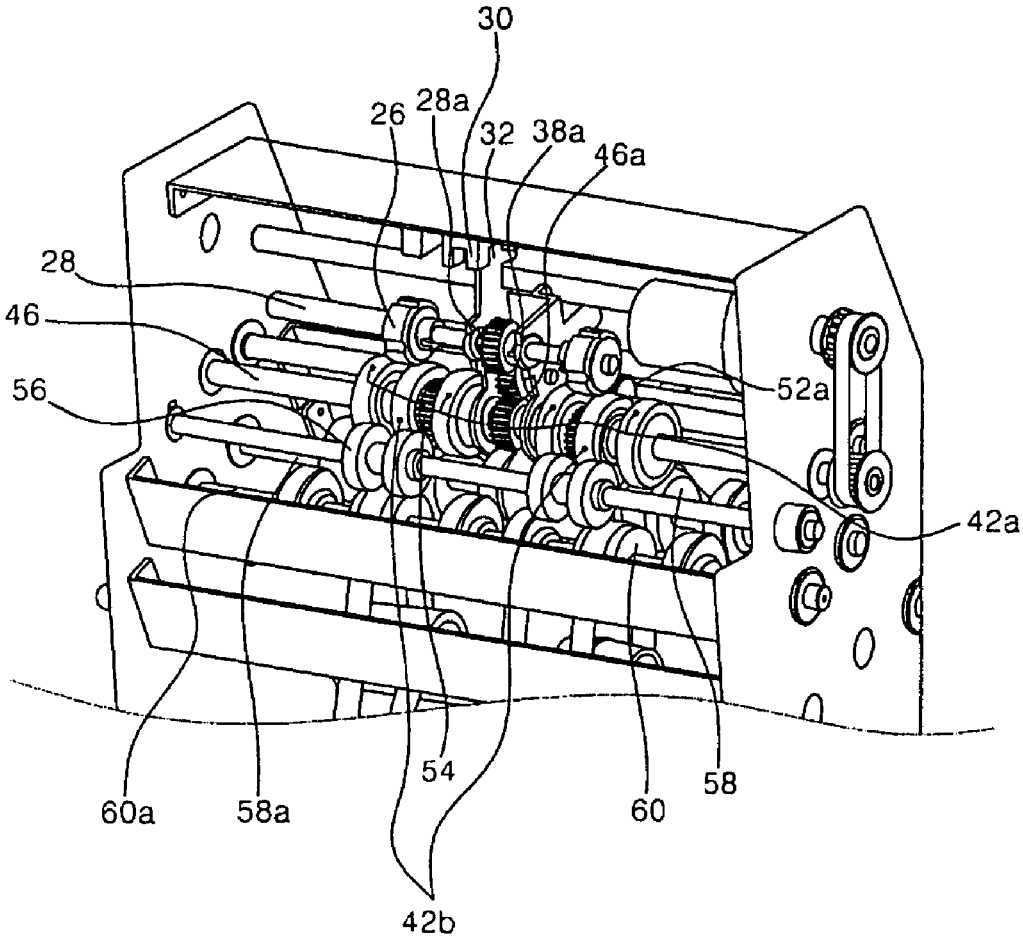
FIG. 3 is a schematic perspective view showing the configuration of the media separating apparatus according to the embodiment of the present invention.

FIG. 2 is a side view showing the configuration of the media separating apparatus for the automatic media dispenser according to the preferred embodiment of the present invention, and FIG. 3 is a schematic perspective view showing the configuration of the embodiment of the present invention.

As shown in these figures, a media box 20 in which a great amount of media m is stored is mounted to the automatic media dispenser such that the media m can be dispensed from the media box. A push plate 22 for pushing the media m in one direction is provided in the media box 20. The push plate 22 is mounted with a spring (not shown) that supports the push plate 22 and pushes the media m in a predetermined direction.

The media m pushed by the push plate 22 are brought into close contact with a pickup roller 24. The pickup roller 24 is installed at a pickup roller shaft 28 driven by a first driving source 26 and serves to pick up and convey the media m. Accordingly, when the first driving source 26 is operated, the pickup roller shaft 28 mechanically coupled to the pickup roller 24 is rotated and the pickup roller 24 then supplies the media m one by one to a feed roller 42 to be described below.

At this time, the first driving source 26 is not always operated but controlled by a control unit (not shown) such that the first driving source is operated only at a specific time. The specific time is a period of time between when the medium m is brought into contact with the pickup roller 24 and ready to be conveyed and when the medium m has been conveyed from the pickup roller 24 to the feed roller 42. That is, electric power for operating the first driving source 26 is supplied when the medium m is ready to be conveyed and cut off when the medium m has been conveyed to the feed roller 42. At this time, the specific time is determined by a pickup sensor 30 and a sensor 34 for sensing the conveyance of media which are provided in the media separating apparatus according to the present invention.

More specifically, the pickup sensor 30 is provided at a position adjacent to the pickup roller 24 and senses how long angular distance the pickup roller 24 is rotated about a certain shaft (in this embodiment, a feed roller shaft 46) other than the pickup roller shaft 28 while the medium m is brought into contact with the pickup roller 24. For reference, in this embodiment, the center of rotation of a bracket 24' on which both ends of the pickup roller shaft 28 are supported becomes the feed roller shaft 46.

The sensing operation of the pickup sensor 30 will be discussed. Since a blocking plate 32 mounted to the bracket 24' or the pickup roller shaft 28 selectively blocks light from the picking sensor 30 according to the rotation of the pickup roller shaft 28, it is determined whether the medium m is ready to be conveyed. In this embodiment, it is sensed whether the medium m is ready to be conveyed in such a manner that the blocking plate 32 uncovers one pickup sensors 30*a* but blocks the other pickup sensor 30*b* while the blocking plate 32 is moving.

Further, the sensor 34 for sensing the conveyance of media (hereinafter, "media conveyance sensor") is provided on a conveying path of the media past first and second conveying rollers 58 and 60 to be described below. When the medium m passes through the first and second conveying rollers 58 and 60 and enters a conveying region, the media conveyance sensor 34 senses the medium m and transmits a certain sensing signal to the control unit. Therefore, in response to the signal sensed by the media conveyance sensor, it is determined whether the first driving source 26 should be switched off.

Not only the pickup roller shaft 28 but also the feed roller shaft 46 are coupled to the first driving source 26 of which operation is determined by the pickup sensor 30 and the media conveyance sensor 34. Accordingly, the first driving source 26 causes not only the pickup roller 24 but also a first feed roller 42*a* to be rotated. At this time, the power transmission from the first driving source 26 to both the pickup roller 24 and the first feed roller 42*a* is achieved through belts and gear trains.

More specifically, as shown in FIG. 2, the power is transmitted from the first driving source 26 to a first idle shaft 38 through a first belt 36 such that a first idle gear 38*a* is rotated. The first idle gear 38*a* is meshed with a second idle gear 40*a* of a second idle shaft 40, which in turn is engaged with the pickup roller shaft 28 and the feed roller shaft 46 through a pickup gear 28*a* and a feed gear 46*a,* respectively. Accordingly, the driving force from the first driving source 26 is sequentially transmitted to the pickup roller shaft 28 and the feed roller shaft 46 through the first and second idle gears 38*a* and 40*a*.

At this time, the first feed roller 42*a* is mounted to the feed roller shaft 46 via a one-way bearing 43. Due to this structure, when the operation of the first driving source 26 is stopped, the first feed roller 42*a* is in an idle state such that the first feed roller can be rotated in a direction in which the medium m is conveyed Furthermore, the feed roller shaft 46 is provided with a second feed roller 42*b* in addition to the first feed roller 42*a*. At this time, the second feed roller 42*b* is coupled to the feed roller shaft 46 via a bearing (not shown). Therefore, the rotating motion of the feed roller shaft 46 is not transmitted to the second feed roller 42*b*. A driving force for rotating the second feed roller 42*b* is transmitted from a second driving source 44. That is, the present embodiment is configured in such a manner that the driving force from the second driving source 44 is transmitted to the second feed roller 42*b* through belts and gear trains.

In other words, the second driving source 44 is coupled to the first conveying roller 58 via a belt 50, and a first conveying roller shaft 58*a* mounted with the first conveying roller 58 is coupled to a second conveying roller shaft 60*a* mounted with the second conveying roller 60 via a gear. Further, the second conveying roller shaft 60*a* is geared with a third idle gear 52*a* of a third idle shaft 52, the third idle gear 52*a* is meshed with a feed idle gear 54. Accordingly, a driving force from the second driving source 44 is transmitted to the second feed roller 42*b* via the first and second conveying roller shafts 58*a* and 60*a,* the third idle gear 52*a* and the feed idle gear 54. At this time, the feed idle gear 54 is directly coupled to the second feed roller 42*b* such that the feed idle gear 54 can be rotated together with the second feed roller 42*b*.

The first and second feed rollers 42*a* and 42*b* are brought into close contact with one surface of the medium m, and thus, the medium m is conveyed by means of a frictional force so generated. The reason that the feed roller is divided into the first and second feed rollers 42*a* and 42*b* is that the conveying forces of the feed roller 42 are differentiated when the medium m is introduced from the pickup roller 24 into the first and second feed rollers 42*a* and 42*b* and when the medium m passes through the first and second feed rollers 42*a* and 42 and then is supplied to the first and second conveying rollers 58 and 60.

In other words, when the medium m is picked up by the pickup roller 24 and introduced into the first and second feed rollers 42*a* and 42*b,* the first and second feed rollers 42*a* and 42*b* should apply a large conveying force to the medium such that the medium m can be conveyed. Accordingly, the first and second feed rollers 42*a* and 42*b* are simultaneously rotated such that the large conveying force can be applied to the medium m.

However, once the medium m is moved out of the pickup roller 24 and introduced into the first and second feed rollers 42*a* and 42*b*, the moving medium m can be conveyed with only a conveying force smaller than the conveying force required before the medium m is introduced into the first and second feed rollers 42*a* and 42*b*. Accordingly, the medium m can be conveyed even though the first feed roller 42*a* is not rotated but only the second feed roller 42*b* is driven.

At this time, since it is possible to design the above configuration in which the first and second feed rollers 42*a* and 42*b* are arranged on the feed roller shaft 46 according to the magnitude of the required conveying force, the arrangement of the rollers is not limited particularly to the aforementioned configuration. In this embodiment, however, the total six feed rollers 42*a* and 42*b* are arranged on the feed roller shaft 46. As shown in FIG. 3, the first, third, fourth and sixth rollers act as the first feed roller 42*a*, while the second and fifth rollers act as the second feed rollers 42*b*.

A separating roller 56 cooperates with the first and second feed rollers 42*a* and 42*b* to separate out the media m one by one. To this end, a plurality of separating rollers 56 are provided such that outer circumferential surfaces of the separating rollers 56 can be brought into contact with the outer circumferential surfaces of the feed rollers 42*a* and 42*b*'. At this time, the separating rollers 56 can be installed to correspond to the first and second feed rollers 42*a* and 42*b* in a stationary state. Otherwise, the separating rollers 56 may be rotated in a direction opposite to the direction in which the media m are conveyed.

A pair of conveying rollers 58 and 60 are provided at a position where the medium has passed through the first and second feed rollers 42*a* and 42*b* and the separating rollers 56. The conveying rollers 58 and 60 can be divided into the first conveying rollers 58 and the second conveying rollers 60. The first and second conveying rollers 58 and 60 are provided on the first and second conveying roller shafts 58*a* and 60*a*, respectively, and then driven by the second driving source 44 as described above. In other words, the first conveying rollers 58 are connected to the second driving source 44 via the second belt 50, and the first conveying roller shaft 58*a* mounted with the first conveying rollers 58 is geared with the second conveying roller shaft 60*a*. Thus, the driving force from the second driving source is transmitted to the second conveying rollers 60. Accordingly, the medium m that has passed through the first and second feed rollers 42*a* and 42*b* and the separating rollers 56 is conveyed to the conveying region by means of the first and second conveying rollers 58 and 60 such that the medium m can be discharged to the outside.

Figure 4:
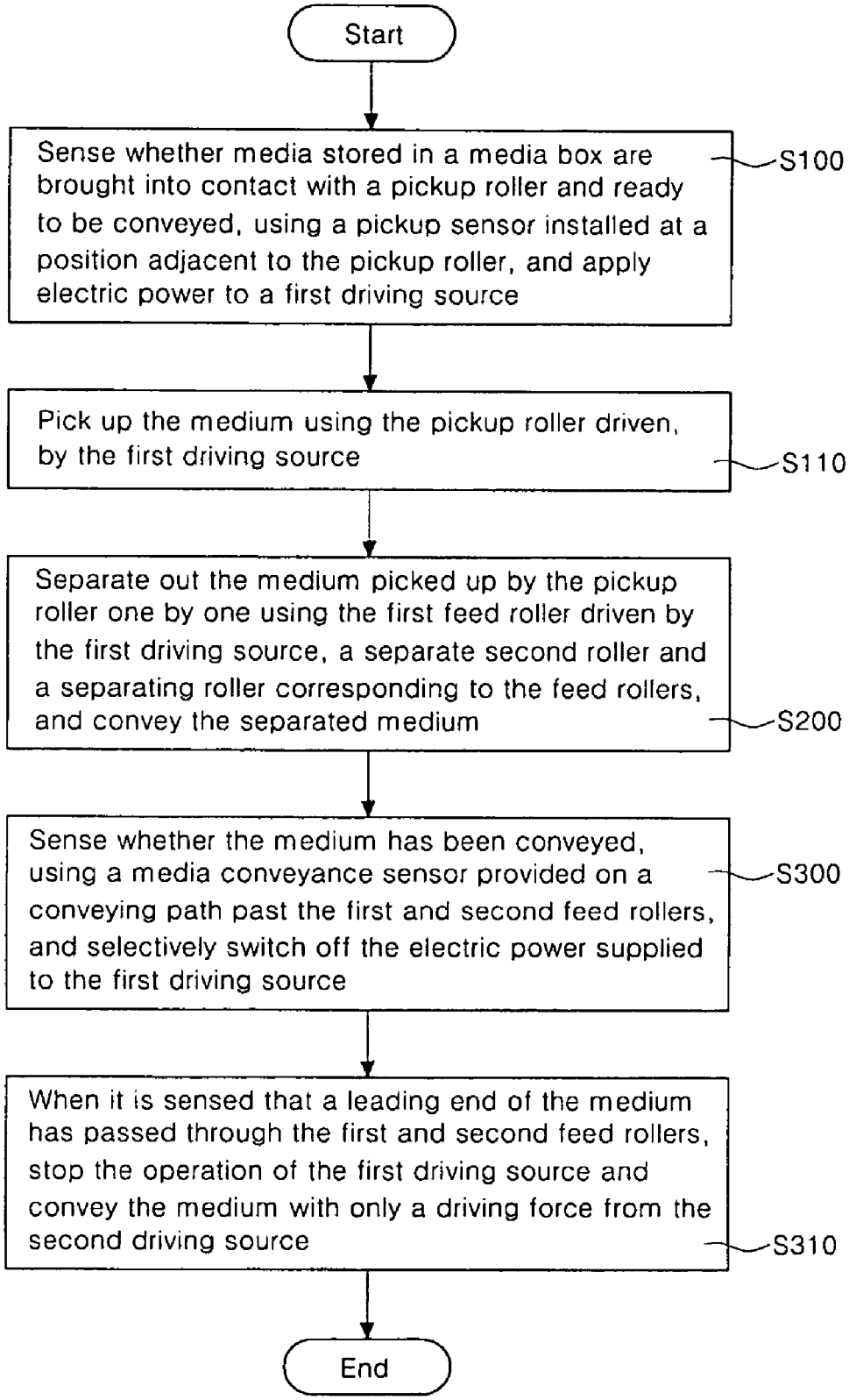
FIG. 4 is a flowchart illustrating a method for separating out a medium in the automatic media dispenser according to the present invention.
Figure 5:
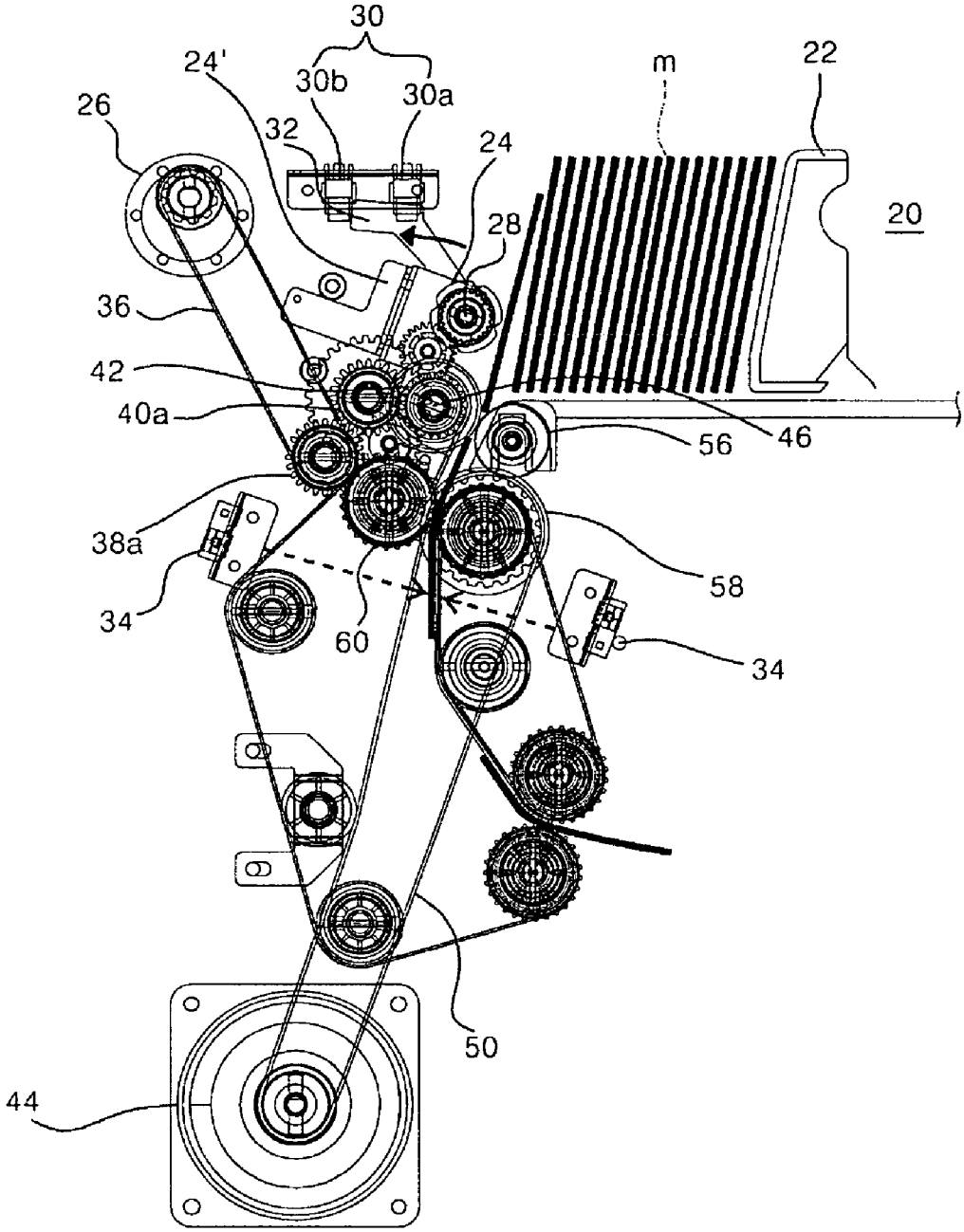
FIG. 5 is a view illustrating the operation of the media separating apparatus according to the embodiment of the present invention.

Hereinafter, a method for separating out the media using the media separating apparatus according to the present invention so configured will be described in detail with reference to FIGS. 4 and 5. Here, to clearly illustrate a conveying path of the media, FIG. 5 shows that the media greater in number than the actually conveyed media have been placed on the media conveying path.

The media m stored in the media box 20 are urged toward the pickup roller 24 by means of the push plate 22. At this time, the movement of the push plate 22 is obtained by an elastic force of a spring mounted to the push plate 22. Thus, even though the media m are brought into contact with the pickup roller 24, the push plate 22 can further push the media m toward the pickup roller 24 due to the elastic force of the spring. Accordingly, the pickup roller 24 is rotated about the feed roller shaft 46 counterclockwise in an angular direction (in a direction shown as a solid line arrow in FIG. 5)

This angular movement of the pickup roller 24 and thus the pickup roller shaft 28 causes the movement of the blocking plate 32 mounted to the pickup roller shaft 28. If the pickup sensor 30 senses the movement of the blocking plate 32, the pickup sensor 30 transmits to the control unit a signal indication that the media m have been brought into contact with the pickup roller 24. The control unit that received the signal operates the first driving source 26 (S100).

At this time, a driving force from the first driving source 26 is transmitted to the pickup roller shaft 28 via the first belt 36, the first idle gear 38*a*, the second idle gear 40*a* and the pickup gear 28*a*, and thus, the pickup roller 24 can be rotated. Accordingly, the medium m is picked up and conveyed by the pickup roller 24 (S110).

However, the driving force from the first driving source 26 is also transmitted to the first feed roller 42*a* via the first belt 36, the first and second idle gears 38*a* and 40*a*, and the feed gear 46*a*. Thus, when the first driving source 26 is operated, the first feed roller 42*a* is simultaneously rotated to apply the conveying force to the medium m conveyed from the pickup roller 24. At this time, the second feed roller 42*b*, which is provided on the feed roller shaft 46 together with the first feed roller 42*a*, is also driven by the second driving source 44. That is, the second driving source 44 is operated at the same time when the first driving source 26 is operated, so that the second driving source rotates the second feed roller 42*b*.

Therefore, the medium m, which has been conveyed and introduced between the first and second feed rollers 42*a* and 42*b* and the separating roller 56 by the pickup roller 24 is advanced between the first and second conveying rollers 58 and 60 by the conveying force of the first and second feed rollers 42*a* and 42*b*. After the medium m is introduced between the first and second conveying rollers 58 and 60, the medium m is discharged from between the first and second conveying rollers 58 and 60 and then conveyed to a discharge port (not shown) along a conveyer belt (S200).

At this time, the media conveyance sensor 34 is provided on the conveying path past the first and second conveying rollers 58 and 60. Thus, the sensor 34 can sense whether the medium m is conveyed along the path as shown as a dotted line arrow in FIG. 5. Accordingly, if the medium m is discharged from between the first and second conveying rollers 58 and 60 and then introduced into the conveying region, the media conveyance sensor 34 senses the presence of medium m and transmits the sensing signal to the control unit. The control unit that received the signal switches off the electric power by which the first driving source 26 is operated, and then stops operating the first driving source 26 (S300).

As the operation of the first driving source 26 is stopped as described above, the pickup roller 24 and first feed roller 42*a* that are driven by the first driving source 26 are also stopped. Therefore, the first feed roller 42*a* mounted to the feed roller shaft 46 via the one-way bearing 43 is in an idle state. Even though the operation of the first driving source 26 is stopped, however, the second driving source 44 is still continuously operated to drive the second feed roller 42*b*.

In other words, when the medium m passes through the pickup roller 24 and is further conveyed by means of the first and second feed rollers 42*a* and 42*b* and the first and second conveying rollers 58 and 60, the pickup roller 24 is stopped and the first feed roller 42*a* is in an idle state, whereas the second feed roller 42*b* is continuously rotated. Accordingly, the pickup roller 24 does not pick up and convey the medium m any more, and a conveying force of the first and second feed rollers 42*a* and 42*b* is reduced so that only the medium m already introduced between the first and second feed rollers

42*a* and 42*b* and the separating roller 56 is conveyed and the other media cannot be further conveyed (S310).

The reason that the first and second feed rollers 42*a* and 42*b* are driven, respectively, by the first and second driving sources 26 and 44 is that the conveying forces applied to the medium m by the first and second feed rollers 42*a* and 42*b* can be different from each other before and after the medium m is introduced between the first and second rollers 42*a* and 42*b* and the separating roller 56. That is, if the conveying forces produced by the first and second feed rollers 42*an* and 42*b* are always kept same, another medium m may be additionally introduced between the first and second feed rollers 2*a* and 42*b* and the separating roller 56 while the previous medium still remains therebetween.

Therefore, when any one of the media m is to be introduced between the first and second feed rollers 42*a* and 42*b* and the separating roller 56, the first and second feed rollers 42*a* and 42*b* should be simultaneously driven in order to pull the medium m therebetween with a large conveying force. Further, after the medium m has been pulled and conveyed by the first and second feed rollers 42*a* and 42*b*, the medium m is conveyed with the conveying force produced by only the second feed roller 42*b* such that the medium m can be smoothly conveyed and the other media m can be prevented from being introduced.

As described above, the media separating apparatus in the automatic media dispenser according to the present invention is configured such that the first driving source is operated and stopped repeatedly according to the position of the media. Thus, the first driving source can selectively drive the pickup roller and the first feed roller. According to the present invention, therefore, if the picked up medium is sensed by the media conveyance sensor, the operation of the first driving source is stopped such that the pickup roller and the first feed roller do not pick up the next medium. Accordingly, there are advantages in that the media cannot be conveyed in a state where they are overlapped with one another and that reliability in the media separation can also be enhanced.

Further, since the first and second feed rollers installed on the feed roller shaft are operated respectively by the first driving source and the second driving source, the conveying forces required to convey the media can vary according to the position of the media.

That is, when the medium is to be introduced between the feed rollers and the separating roller, the first and second driving sources are operated simultaneously to rotate the first and second feed rollers at the same time. Thus, the first and second feed rollers can produce the relatively large conveying force. Then, after it is sensed that a leading end of the medium has passed between the feed rollers and the separating roller, the operation of the first driving source is stopped. Thus, since the first feed roller is rotated no longer, the conveying force can be reduced and the relatively small conveying force is applied to the medium. Therefore, since the first and second feed rollers are selectively driven according to the conveying force required to convey the media, unnecessary friction force applied to the media can be reduced. Accordingly, there is another advantage in that the damage of the media surface can be reduced.

The scope of the present invention is not limited to the embodiment described above but is defined by the appended claims. It will be apparent to those skilled in the art that various changes and modifications can be made without departing from the scope defined in the claims.

For example, it has been described in the illustrated embodiment that the first and second feed rollers 42*a* and 42*b* are installed on a single feed roller shaft 46, but it is not necessarily limited thereto. That is, the first and second feed rollers 42*a* and 42*b* can be installed on the separate feed roller shafts, respectively.

What is claimed is:

1. A media separating apparatus for an automatic media dispenser, comprising:

a pickup roller for picking up and conveying media stored in a media box, said pickup roller being installed on a pickup roller shaft;

a plurality of feed rollers located downstream of the pickup roller for conveying the media with a friction force, said feed rollers being installed on feed roller shafts and being selectively and separately driven by separate driving sources; and a plurality of separating rollers installed to correspond to outer circumference surfaces of the feed rollers, said separating rollers cooperating with the feed rollers to separate out the media one by one.

2. The apparatus as claimed in claim 1, wherein the separating rollers are in a stationary state or rotated in a direction opposite to a direction in which the media are conveyed.

3. The apparatus as claimed in claim 1, wherein some of the feed rollers are mounted to a corresponding feed roller shaft via a one-way bearing such that some of the feed rollers are rotated integrally with the corresponding feed roller shaft when the corresponding feed roller shaft is rotated and are in an idle state when the corresponding feed roller shaft is in a stationary state.

4. The apparatus as claimed in claim 1, wherein the plurality of feed rollers are installed and independently driven on separate feed roller shafts.

5. The apparatus as claimed in claim 1, wherein the separate driving sources comprise at least two driving sources for driving the plurality of feed rollers.

6. The apparatus as claimed in claim 5, wherein one of the driving sources is a driving source for driving the pickup roller.

7. The apparatus as claimed in claim 1, further comprising a pickup sensor installed at a position adjacent to the pickup roller for sensing whether the medium is ready to be conveyed, wherein the pickup roller is rotated to convey the medium to the feed roller when it is sensed in the pickup sensor that the medium is ready to be conveyed.

8. The apparatus as claimed in claim 1, further comprising a media conveyance sensor for sensing whether the media have been conveyed, wherein the media conveyance sensor is installed on a conveying path past the feed roller in a direction in which the media are conveyed, and the pickup roller is stopped to prevent additional media from being picked up when it is sensed in the media conveyance sensor that the media have been conveyed.

9. A method for separating out media in an automatic media dispenser, comprising the steps of:

(a) picking up the media stored in a media box using a pickup roller;

(b) conveying the medium picked up by the pickup roller using a plurality of selectively driven feed rollers located downstream of the pickup roller, wherein first selectively driven feed rollers are driven by a first drive source and a second separately driven feed roller is driven by a second separate drive source; and (c) stopping only the first drive source and only the first feed rollers when it is sensed that a leading end of the medium has passed through the feed rollers.

10. The method as claimed in claim 9, further comprising the step of, prior to step (a), sensing whether the medium is ready to be conveyed, using a pickup sensor installed at a position adjacent to the pickup roller, and selectively operating the plurality of feed rollers in response to the sensing result.

11. The method as claimed in claim 9, further comprising the step of sensing whether the medium has been conveyed, using a media conveyance sensor provided on a media conveying path, and stopping an operation of the pickup roller in response to the sensing result.

12. A media separating apparatus for an automatic media dispenser, comprising:

a pickup roller for picking up and conveying media stored in a media box, said pickup roller being installed on a pickup roller shaft driven by a first driving source;

a plurality of first feed rollers installed downstream of the pickup roller on a feed roller shaft adapted to be driven by the first driving source and brought into close contact with one surface of the medium to convey the medium using a friction force generated between the medium and the first feed rollers;

a second feed roller separate from the plurality of first feed rollers and installed on the feed roller shaft via a bearing and adapted to be rotated by a second driving source driven separately from the first driving source to convey the medium; and a plurality of separating rollers installed downstream of the first feed rollers to correspond to outer circumference surfaces of the first and second feed rollers and to separate out the media one by one in cooperation with the first and second feed rollers.

13. The apparatus as claimed in claim 12, wherein the first feed rollers are mounted to the feed roller shaft via a one-way bearing such that some of the feed rollers are rotated integrally with the feed roller shaft when the feed roller shaft is rotated and are in an idle state when the feed roller shaft is in a stationary state.

14. The apparatus as claimed in claim 12, further comprising a pickup sensor installed at a position adjacent to the pickup roller for sensing whether the medium is brought into contact with the pickup roller and ready to be conveyed, wherein when it is sensed in the pickup sensor that the medium is ready to be conveyed, electric power is supplied to the first driving source such that the pickup roller is rotated to convey the medium between the first and second feed rollers and the separating rollers.

15. The apparatus as claimed in claim 14, further comprising a media conveyance sensor for sensing whether the media have been conveyed, wherein the media conveyance sensor is installed on a conveying path past the first and second feed rollers in a direction in which the media are conveyed, and the electric power supplied to the first driving source is switched off such that the pickup roller is stopped to prevent additional media from being picked up, when it is sensed in the media conveyance sensor that the media have been conveyed.

16. The apparatus as claimed in claim 12, wherein the separating rollers are in a stationary state or rotated in a direction opposite to a direction in which the media are conveyed.

17. A method for separating out media in an automatic media dispenser, comprising the steps of:

(a) picking up the media stored in a media box using a pickup roller driven by a first driving source;

(b) separating out the media picked up from the media box one by one and conveying the separated medium using a first feed roller located downstream of the picking roller driven by the first driving source, a second feed roller located downstream of the picking roller driven by a separate second driving source and separating rollers corresponding to the first and second feed rollers;

(c) sensing when a leading end of a medium has passed through the first and second feed rollers; and (d) when it is sensed that a leading end of the medium has passed through the first and second feed rollers, stopping an operation of the first driving source and then conveying the medium using only a driving force from the second driving source.

18. The method as claimed in claim 17, further comprising the step of, prior to step (a), sensing whether the medium is brought into contact with the pickup roller and ready to be conveyed, using a pickup sensor installed at a position adjacent to the pickup roller, and selectively applying electric power to the first driving source in response to the sensing result.

19. The method as claimed in claim 18, further comprising the step of, prior to step (c), sensing whether the medium has been conveyed, using a media conveyance sensor provided on a media conveying path past the first and second feed rollers, and selectively switching off the electric power supplied to the first driving source.

* * * * *